US009062491B2

(12) United States Patent
Eansor

(10) Patent No.: US 9,062,491 B2
(45) Date of Patent: Jun. 23, 2015

(54) INFLATABLE WEATHERSTRIP SYSTEM

(71) Applicant: Norman David Eansor, Centennial, CO (US)

(72) Inventor: Norman David Eansor, Centennial, CO (US)

( * ) Notice: Subject to any disclaimer, the term of this patent is extended or adjusted under 35 U.S.C. 154(b) by 0 days.

(21) Appl. No.: 14/179,500

(22) Filed: Feb. 12, 2014

(65) Prior Publication Data

US 2014/0223828 A1 Aug. 14, 2014

Related U.S. Application Data

(60) Provisional application No. 61/763,867, filed on Feb. 12, 2013.

(51) Int. Cl.
*E06B 7/18* (2006.01)
*E06B 7/23* (2006.01)

(52) U.S. Cl.
CPC ..... *E06B 7/2318* (2013.01); *E06B 7/2316* (2013.01)

(58) Field of Classification Search
CPC ..... E06B 7/2316; E06B 7/2318
USPC ..... 49/475.1, 477.1, 506
See application file for complete search history.

(56) References Cited

U.S. PATENT DOCUMENTS 2,908,948 A * 10/1959 Jones ..... 49/303
3,100,918 A * 8/1963 Coverley ..... 49/477.1
3,110,065 A * 11/1963 Dennis ..... 49/477.1
3,968,597 A * 7/1976 Hirtle ..... 49/477.1
4,343,110 A * 8/1982 Thompson ..... 49/477.1
4,706,413 A * 11/1987 James ..... 49/477.1
4,989,370 A * 2/1991 Smith ..... 49/477.1
5,046,285 A * 9/1991 Fratini et al. ..... 49/477.1
5,090,765 A * 2/1992 Gremillion ..... 296/180.1
5,279,087 A * 1/1994 Mann ..... 52/232
7,578,097 B2 * 8/2009 Dondlinger et al. ..... 49/477.1
7,958,674 B2 * 6/2011 Meister ..... 49/318
2012/0222361 A1 * 9/2012 Farucci et al. ..... 49/475.1

FOREIGN PATENT DOCUMENTS

GB 2220434 A * 1/1990 ..... E06B 7/23

* cited by examiner

*Primary Examiner* — Jerry Redman

(74) *Attorney, Agent, or Firm* — Jackson Walker L.L.P.

(57) ABSTRACT

A sealing system for doors and windows includes a reservoir device, a sealing tube configured to expand and to contract, and a transfer valve configured to couple the reservoir device to a first end of the sealing tube. Responsive to either of a door or window closing, a medium may be transferred from the reservoir device via the transfer valve to the sealing tube. Responsive to receiving the medium, the sealing tube may expand to substantially seal a gap between an edge of either of the door or the window and a surface in proximity to the edge. Responsive to either of the door or window opening, the medium may be discharged from the sealing tube via the transfer valve. The sealing tube may contract in response to discharging the medium.

21 Claims, 4 Drawing Sheets

INFLATABLE WEATHERSTRIP SYSTEM

CROSS REFERENCE TO RELATED APPLICATIONS

This application claims priority from U.S. Provisional Patent Application No. 61/763,867, filed on Feb. 12, 2013, entitled "INFLATABLE WEATHERSTRIP", which is incorporated by reference herein. An application data sheet containing this priority claim is submitted herewith.

BACKGROUND

1. Field of the Disclosure

This disclosure relates to the field of sealing systems, and more particularly to an inflatable weatherstrip system for sealing doors and windows.

2. Description of the Related Art

Many conventional sealing systems for doors and windows are passively designed with a weatherstrip material. The weatherstrip is typically an elastomeric material that provides a sealing element between the door or window and a corresponding frame. The sealing properties of these sealing systems are often inadequate and contribute to higher energy consumption and costs related to air both entering and exiting the applicable structure through gaps in the weatherstripping around the door or window. Conventional weatherstripping is also problematic in that its size and configuration may result in it dragging on the door threshold and floor, eventually tearing away or becoming damaged, and thus, potentially requiring frequent replacement.

DESCRIPTION OF EXEMPLARY EMBODIMENT(S)

Figure 1:
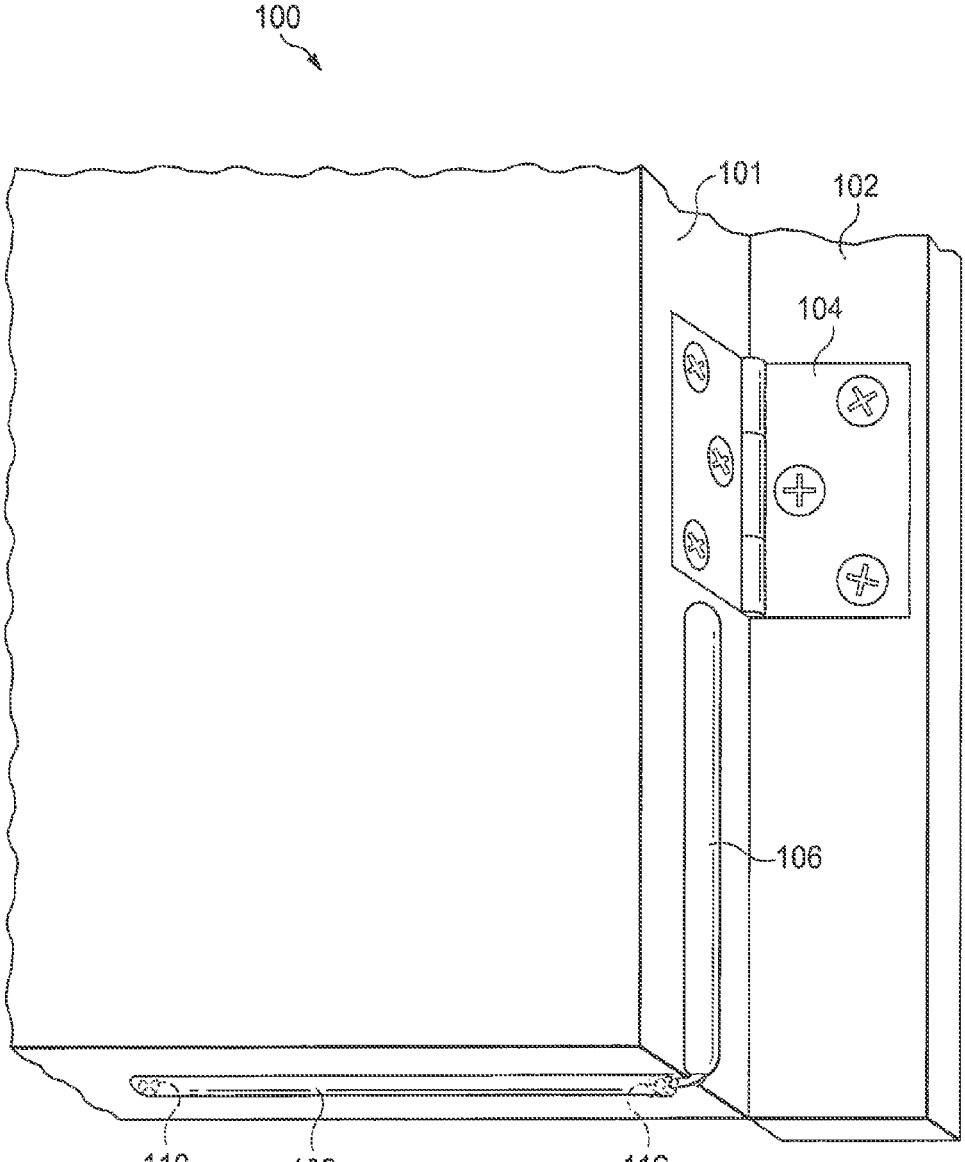
FIG. 1 illustrates selected elements of an embodiment of an inflatable weatherstrip system with a corresponding door in an open position.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Disclosed subject matter pertains to a system and method for use in the sealing of doors and windows. Disclosed herein is a sealing system that provides an inflatable seal around one or more edges of a door or window when the door or window is closed. In one embodiment, a compressible reservoir device which may be placed between a door and a door jamb or a window and a window casing serves as a reservoir for a medium that is used to inflate an inflatable sealing tube when the reservoir device is compressed as a result of the door or window being closed. The reservoir device may contain all or substantially all of the medium when the door or window is open. The sealing tube may be located around one or more edges of the door or window. In another embodiment, the reservoir device may be located at a position other than adjacent to a door jamb or window casing and a separate compression mechanism may be used to compress the reservoir device when the door or window is closed.

In one embodiment, a sealing system includes a reservoir device, a sealing tube configured to expand and to contract, and a transfer valve configured to couple the reservoir device to a first end of the sealing tube. Responsive to either of a door or window closing, a medium initially contained in the reservoir device may be transferred to the sealing tube via the transfer valve. Responsive to receiving the medium, the sealing tube may expand to substantially seal a gap between an edge of either of the door or the window and a surface in proximity to the edge. Responsive to either of the door or window opening, the medium may be discharged or otherwise withdrawn from the sealing tube via the transfer valve or a different valve. The sealing tube may contract in response to discharging the medium.

In one embodiment, the medium includes a gas. In another embodiment, the medium includes a liquid.

In a further embodiment, the reservoir device may include a bladder configured to hold the medium. The bladder may be configured to contract and discharge all or a portion of the medium via the transfer valve into the sealing tube responsive to either of the door or window closing. Responsive to the sealing tube contracting, all or a portion of the medium may be discharged via the transfer valve into the reservoir device.

In some embodiments, the transfer valve may be configured to store a pressurized volume of the medium received from the reservoir device responsive to either of the door or window closing and may further be configured to transfer a portion of the stored pressurized volume of the medium into the sealing tube after either of the door or the window is in a substantially closed position. In other embodiments, the transfer valve may be configured to store a pressurized volume of the medium received from the sealing tube responsive to either of the door or window opening and may further be configured to transfer a portion of the stored pressurized volume of the medium into the reservoir device after either of the door or window is in a substantially open position.

In one embodiment, the transfer valve is embedded substantially in either of the door or the window. In another embodiment, the transfer valve is embedded substantially in either of a door jamb associated with the door or a window casing associated with the window. In some embodiments, the sealing tube is embedded substantially in a longitudinal channel defined in a longitudinal surface of either of the door or the window. In other embodiments, the sealing tube may be embedded substantially in a longitudinal channel defined in a longitudinal surface of either a door jamb associated with the door or a window casing associated with the window. In at least one embodiment, the sealing tube is affixed to a longitudinal surface of either of the door, the window, a door jamb associated with the door, or a window casing associated with the window.

The sealing tube may, in some embodiments, include a ruggedized flexible covering. In some embodiments, the sealing system may further include a second valve coupled to a second end of the sealing tube. The second valve may be configured to release a portion of the medium in response to a pressure of the medium in the sealing tube reaching a predetermined threshold. In some embodiments, the second valve may be configured to release portions of the medium until the pressure reaches a predetermined desired pressure. In some embodiments, the second valve may be configured to release a portion of the medium in response to an indication that either of the door or the window is opening. In at least one embodiment, the second valve is configured to receive and introduce additional medium so as to increase the volume of the medium in the sealing tube.

In one embodiment, the sealing system includes a sealing tube configured to expand and to contract and a transfer valve coupled to the sealing tube. In at least one embodiment, the transfer valve may be configured to receive and store a pressurized volume of a gas responsive to detecting a closing of either of a door or a window and may further be configured to transfer a portion of the stored pressurized volume of the gas into the sealing tube after either of the door or the window is in a substantially closed position. Responsive to receiving the gas, the sealing tube may, in some embodiments, expand to substantially seal a gap defined between an edge of either of the door or the window and a surface in proximity to the edge when the door or window is closed. The transfer valve may be configured to release a portion of the gas from the sealing tube responsive to detecting an opening of either of the door or the window. In at least one embodiment, responsive to the release of the gas from the sealing tube, the sealing tube contracts. In some embodiments, the transfer valve receives the pressurized volume of gas from a generation device 120. In at least one embodiment, the generation device includes an air compressor.

In at least one embodiment, a method of sealing either of a door or a window includes detecting by a sealing system, either an opening or a closing of either of the door or the window. The sealing system includes in some embodiments a reservoir device, a sealing tube configured to expand and to contract, and a transfer valve configured to couple the reservoir device to a first end of the sealing tube. Responsive to either of the door or window closing, the system may transfer a medium from the reservoir device via the transfer valve to the sealing tube. Responsive to receiving the medium, the sealing tube may expand to substantially seal a gap between an edge of either of the door or the window and a surface in proximity to the edge. In some embodiments, responsive to either of the door or window opening, discharging the medium from the sealing tube via the transfer valve may occur and responsive to discharging the medium, the sealing tube may contract.

In the following description, details are set forth by way of example to facilitate discussion of the disclosed subject matter. It should be apparent to a person of ordinary skill in the field, however, that the disclosed embodiments are exemplary and not exhaustive of all possible embodiments.

Turning now to the figures, FIG. 1 illustrates selected elements of an embodiment of sealing system 100. As shown, sealing system 100 may include various elements and components, of which certain ones are shown in an exemplary embodiment for descriptive clarity. It is noted that in various embodiments of sealing system 100, elements may be added and/or omitted. As will be described in further detail, disclosed embodiments of sealing system 100 may be attached (or affixed) to a door or the door frame associated with the door (also referred to as a door jamb) to enable sealing of the door in the door frame, and more particularly, to provide an inflatable seal that seals a portion of the space between the edges of the door and the surrounding surfaces in proximity to those edges. While the embodiments disclose the use of sealing system 100 with a door, it will be appreciated that sealing system 100 may be attached (or affixed) to a window or the window casing associated with the window to enable sealing of the window in the window casing, and more particularly, to provide an inflatable seal that seals a portion of the space between the edges of the window and the surrounding surfaces in proximity to those edges and that in the figures and descriptions herein, references to doors and doors frames or jambs are intended to include windows and window casings, respectively. Similarly, references to door or windows encompass any suitable panel structure movably affixed to an opening between two volumes. Further, while the disclosed embodiments refer to the use of an internal pressurized gas as the medium to inflate the inflatable seal, it will be appreciated that other mediums such as pressurized liquids and gels may be used as well to inflate the inflatable seal.

As shown in FIG. 1, sealing system 100 includes door 101 supported by door hinge 104 at door jamb 102, which forms a portion of a door frame (not shown) within which door 101 is installed. In FIG. 1, a bottom corner portion of door 101 is depicted for clarity while door 101 is shown in an open position with respect to door jamb 102. Attached to door 101 is reservoir device 106 and sealing tube 108, which together form a flexible chamber that may be pressurized. Reservoir device 106 and sealing tube 108 may expand and contract in response to the volume of media stored therein. Sealing tube 108, as shown, may be attached to a bottom edge or portion of door 101, for example, in a longitudinal groove channel defined in a longitudinal surface of door 101 within which sealing tube 108 may be affixed. In other embodiments, sealing tube 108 may be attached to any edge or portion of door 101 and/or any face of door jamb 102 by any fastening mechanism, including adhesive strips such as Velcro™, staples, tacks, nails, screws, magnets, other attachment hardware, or an adhesive applied to either or both door 101 and sealing tube 108 and either or both door jamb 102 and sealing tube 108. Sealing tube 108 may also, in some embodiments, be attached to a longitudinal groove channel defined in a longitudinal surface of door jamb 102 within which sealing tube 108 may be affixed.

Reservoir device 106 may be affixed to either of door 101 or door jamb 102 by any fastening mechanism, including adhesive strips such as Velcro™, staples, tacks, nails, screws, magnets, other attachment hardware, or an adhesive applied to either or both door 101 and reservoir device 106 and either or both door jamb 102 and reservoir device 106. In the depicted embodiment, reservoir device 106 is affixed to the edge of door 101 that is pivotally connected, by way of hinge 104, to door jamb 102 so that when door 101 is moved into a closed position, reservoir device 106 is compressed between the edge of door 101 and the face of door jamb 102. In another embodiment, reservoir device 106 may be affixed to the face of door jamb 102 that is pivotally connected to door 101 such that when door 101 is moved into a closed position, reservoir device 106 is compressed between the edge of door 101 and the face of door jamb 102. In one embodiment, reservoir device 106 includes a bladder. It will be appreciated that, while not depicted, reservoir device 106 may be affixed to any edge of door 101 or to any face of door jamb 102 so that when door 101 is moved into a closed position, reservoir device 106 is compressed between an edge of door 101 and a face of door jamb 102.

Although only a portion of sealing tube 108 is shown in FIG. 1, sealing tube 108 may extend over one or more edges of door 101 or one or more faces of door jamb 102 to provide an inflatable sealing element. As depicted in FIG. 1, sealing tube 108 may be embedded substantially in a longitudinal channel defined in a longitudinal surface of either of one or more edges of door 101 or one or more faces of door jamb 102. In alternative embodiments, sealing tube 108 may be affixed to a longitudinal surface of either of one or more edges of door 101 or one or more faces of door jamb 102. In some embodiments, when sealing tube 108 is affixed to or embedded substantially in one or more edges of door 101, sealing tube 108 may be shaped in such a way that it comes to a point, or substantially narrows, at the point where it comes in contact with any or all portions of door jamb 102 when sealing tube 108 is inflated so as, among other benefits, to reduce friction as sealing tube 108 encounters door jamb 102 while inflating, and to reduce friction when opening door 101. In some embodiments, when sealing tube 108 is affixed to or embedded substantially in one or more faces of door jamb 102, sealing tube 108 may be shaped in such a way that it comes to a point, or substantially narrows, at the point where it comes in contact with any or all edges of door 101 when sealing tube 108 is inflated so as, among other benefits, to reduce friction as sealing tube 108 encounters door 101 while inflating, and to reduce friction when opening door 101. To reduce wear and tear, sealing tube 108 may include a ruggedized flexible covering. In some embodiments, the ruggedized flexible covering includes an elastomeric.

In one embodiment, secondary valve 110 is connected to one end of sealing tube 108 and may allow for inflation of sealing tube 108 with a hand pump or a compressor or air tank of compressed gas so that an additional amount of gas or other medium may be introduced into sealing tube 108 when door 101 is in a closed or substantially closed position. In alternative embodiments, secondary valve 110 may permit the discharge or release of gas or other medium from sealing tube 108 in instances when a predetermined threshold of the pressure of the medium contained in sealing tube 108 is reached. For example, secondary valve 110 may be configured to release pressure when the pressure reaches a limit threshold until the pressure attains a desired pressure. Such a discharge or release may prevent the overfilling of sealing tube 108. In another embodiment, at one end of sealing tube 108 is transfer valve 112, which may separate sealing tube 108 from reservoir device 106. In some embodiments, transfer valve 112 may be configured with a compartment (not depicted) to store a pressurized volume of the medium received from reservoir device 106 responsive to door 101 closing and is further configured to transfer a portion of the stored pressurized volume of the medium into sealing tube 108 after door 101 is in a substantially closed position so as to delay the expansion of sealing tube 108 until after door 101 is in a substantially closed position. In further embodiments, transfer valve 112 is configured to store a pressurized volume of the medium received from sealing tube 108 responsive to door 101 opening and is further configured to transfer a portion of the stored pressurized volume of the medium into reservoir device 106 after door 101 is in a substantially open position.

In some embodiments, reservoir device 106 may provide a reservoir for a medium such as a gas (e.g., air, nitrogen, helium, etc.) or a liquid. In one embodiment, transfer valve 112 may enable the medium to cycle back and forth between reservoir device 106 and sealing tube 108. Transfer valve 112 may be configured to sustain a relatively small pressure differential to prevent inadvertent or unintended transfer of the medium. In one embodiment, when door 101 opens, the pressure inside of reservoir device 106 is reduced such that the medium within sealing tube 108 flows into reservoir device 106. In some embodiments, the type of medium within sealing tube 108 may assist with the action. For example, any gas that is lighter than air may, when door 101 is in an open position such that reservoir device 106 is not fully compressed, flow more quickly from sealing tube 108 to reservoir device 106 when reservoir device 106 is located above sealing tube 108 as is depicted in FIG. 1 and may conversely fill sealing tube 108 more slowly when door 101 is moved into a closed position so as to compress reservoir device 106. Further, the shape and type of material, including elasticity of the material or materials, used to construct reservoir device 106 and sealing tube 108, may assist with the movement of the medium between reservoir device 106 and sealing tube 108. For example, sealing tube 108 may be constructed in a manner so that its elasticity is lower than that of reservoir device 106 such that the pressure of the medium within sealing tube 108 causes the medium to flow into reservoir device 106 when door 101 is open and reservoir device 106 is not compressed. In one embodiment, transfer valve 112 may be similar to valves used in connection with liquids stored in bag-within-a-box products such as boxed wines. In another embodiment, all or a portion of the medium in sealing tube 108 may not be returned from sealing tube 108 to reservoir device 106, but rather may be exhausted from sealing system 100 by way of secondary valve 110, transfer valve 112, or another suitable valve (not depicted) and reservoir device 106 may (upon the opening of door 101) recharge itself by way of transfer valve 112 or another suitable valve with the applicable medium when reservoir device 106 returns to its pre-compressed state. For example, in instances when the medium is air, reservoir 106 may recharge itself with an additional volume of air from the surrounding environment when returning to its pre-compressed state following the opening of door 101.

The description of sealing system 100 in FIG. 1 is intended as a functional representation, and is not intended to restrict any specific physical implementation to a particular form or dimension. For example, different implementations of sealing system 100 may be employed with different types of doors and windows, as is suitable and/or desired. By way of illustration, one embodiment of sealing system 100 (while not depicted) may be employed with a sliding door or window wherein the reservoir device is located at the end opposite the latched side when the sliding door or window is in the closed position. The reservoir device may be located inside a portion of this opposite end and a spring-loaded or other mechanism accessible to a user may permit the user to selectively compress the reservoir device manually. Automated mechanisms such as compressors 120 or compressed air tanks may be included as well in order to provide the media to transfer valve 112 and to transfer valve 110. In alternative embodiments, multiple reservoir devices may also be employed.

Figure 2:
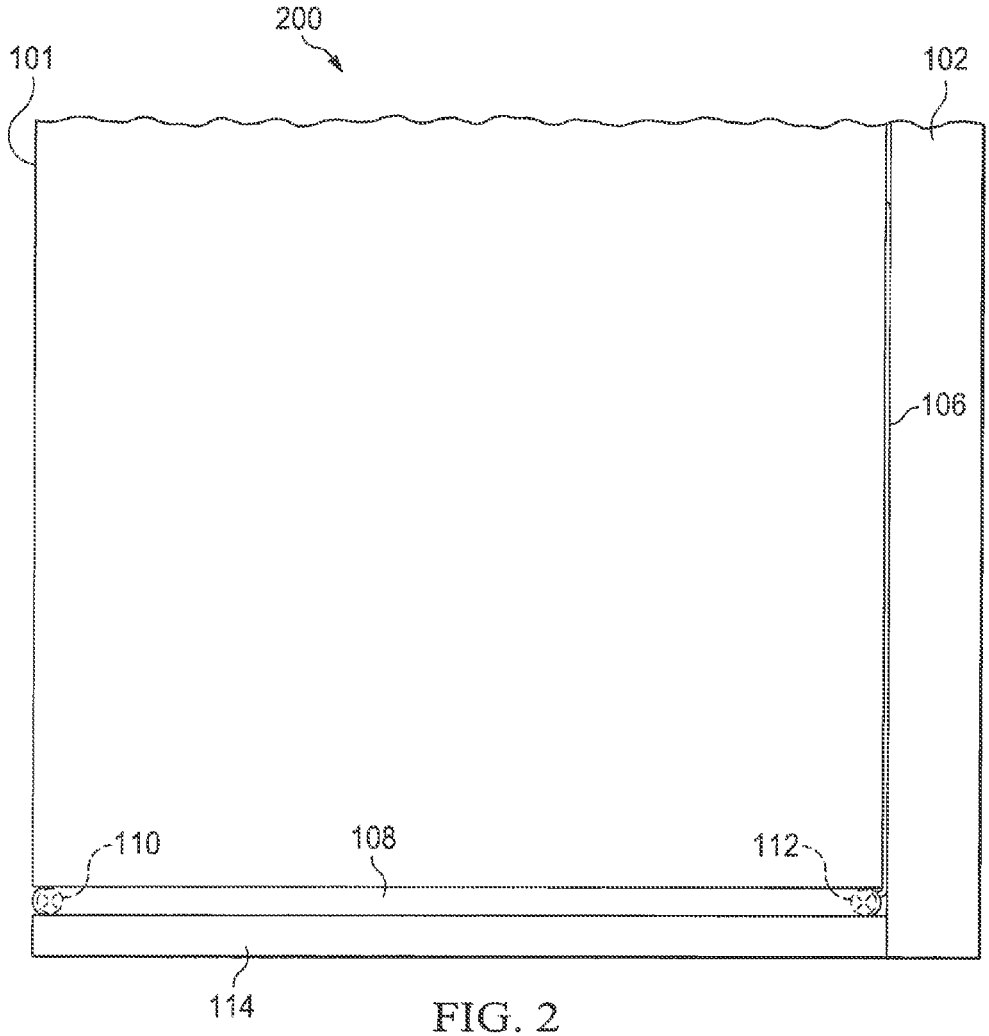
FIG. 2 illustrates the inflatable weatherstrip system of FIG. 1 with the door in a closed position.
Figure 3:
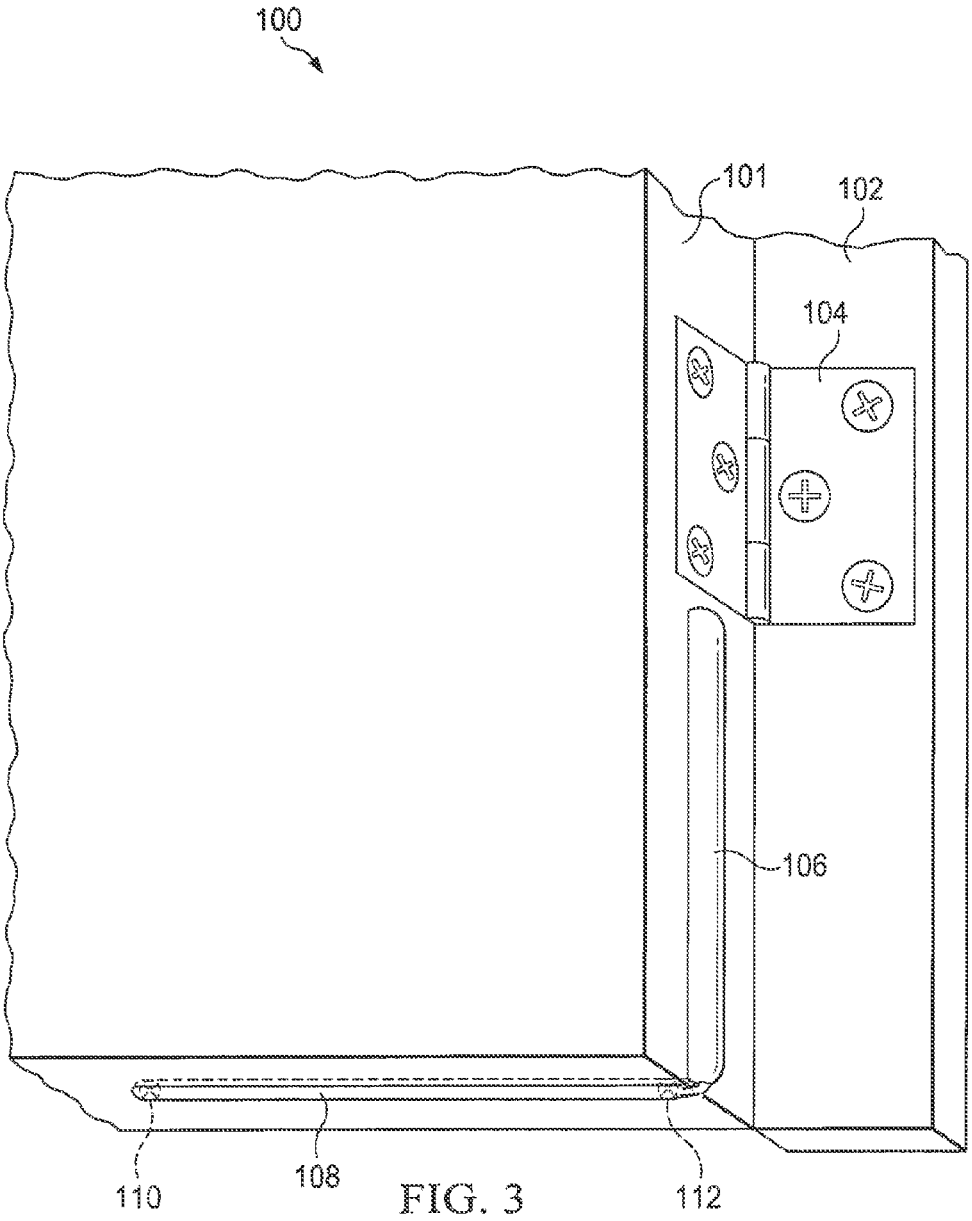
FIG. 3 further illustrates selected elements of an embodiment of an inflatable weatherstrip system with a corresponding door in an open position.
Figure 4:
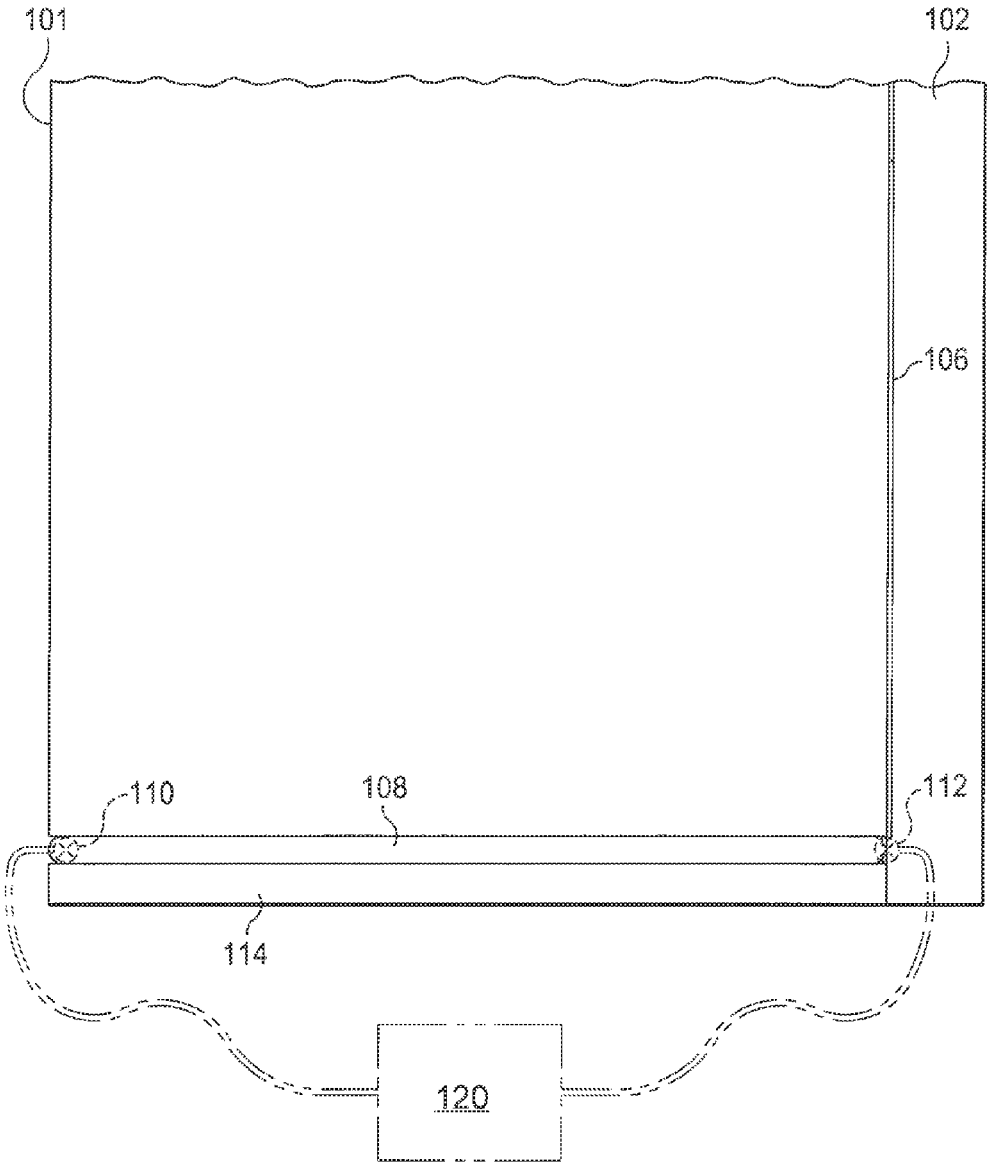
FIG. 4 further illustrates selected elements of an embodiment of an inflatable weatherstrip system with a corresponding door in a closed position.

Turning now to FIG. 2, selected elements of an embodiment of sealing system 200 are shown. As shown, sealing system 200 may represent an embodiment of sealing system 100 when door 101 is in a closed position with respect to door jamb 102. In sealing system 200, reservoir device 106 has been compressed between an edge of door 101 that mates with door jamb 102. Upon compression of reservoir device 106, transfer valve 112 may open and allow the medium to be discharged from reservoir device 106 and accumulated in sealing tube 108. As shown, sealing tube 108 may form a substantially airtight seal between a bottom edge of door 101 and door threshold 114. Although not depicted, it will be understood that sealing tube 108 may extend over any of the other edges of door 101 to form a substantially airtight seal between the corresponding edge of door 101 and whatever surface such edges abut, including other doors (not depicted) or door jamb 102.

To the maximum extent allowed by law, the scope of the present disclosure is to be determined by the broadest permissible interpretation of the following claims and their equivalents, and shall not be restricted or limited to the specific embodiments described in the foregoing detailed description.

What is claimed is:

1. A sealing system comprising:

a reservoir device;

a sealing tube configured to expand and to contract; and a transfer valve configured to couple the reservoir device to a first end of the sealing tube;

wherein responsive to either of a door or window closing, a medium is transferred from the reservoir device via the transfer valve to the sealing tube, and further wherein responsive to receiving the medium, the sealing tube expands to substantially seal a gap between an edge of either the door or the window and a surface in proximity to the edge;

wherein responsive to either of the door or window opening, the medium is discharged from the sealing tube via the transfer valve, and further wherein responsive to discharging the medium, the sealing tube contracts; and wherein the transfer valve is embedded substantially in either of the door or the window.

2. The sealing system of claim 1, wherein the medium includes a gas.

3. The sealing system of claim 1, wherein the reservoir device includes a bladder configured to hold the medium and wherein the bladder is configured to contract and discharge a portion of the medium via the transfer valve into the sealing tube responsive to either of the door or the window closing.

4. The sealing system of claim 3, wherein responsive to the sealing tube contracting, a portion of the medium is discharged via the transfer valve into the reservoir device.

5. The sealing system of claim 1, wherein the transfer valve is configured to store a pressurized volume of the medium received from the reservoir device responsive to either of the door or the window closing and further configured to transfer a portion of the stored pressurized volume of the medium into the sealing tube after either of the door or window is in a substantially closed position.

6. The sealing system of claim 1, wherein the transfer valve is configured to store a pressurized volume of the medium received from the sealing tube responsive to either of the door or the window opening and further configured to transfer a portion of the stored pressurized volume of the medium into the reservoir device after either of the door or the window is in a substantially open position.

7. The sealing system of claim 1, wherein the sealing tube is affixed to a longitudinal surface of either of a door jamb associated with the door or a window casing associated with the window.

8. The sealing system of claim 1, further comprising:

a second valve coupled to a second end of the sealing tube.

9. The sealing system of claim 8, wherein the second valve is configured to release a portion of the medium in response to a pressure of the medium in the sealing tube reaching a predetermined threshold.

10. The sealing system of claim 8, wherein the second valve is configured to release a portion of the medium in response to an indication that either of the door or the window is opening.

11. The sealing system of claim 8, wherein the second valve is configured to receive and introduce additional medium so as to increase the volume of the medium in the sealing tube.

12. A sealing system comprising:

a reservoir device;

a sealing tube configured to expand and to contract; and a transfer valve configured to couple the reservoir device to a first end of the sealing tube;

wherein responsive to either of a door or window closing, a medium is transferred from the reservoir device via the transfer valve to the sealing tube, and further wherein responsive to receiving the medium, the sealing tube expands to substantially seal a gap between an edge of either the door or the window and a surface in proximity to the edge;

wherein responsive to either of the door or window opening, the medium is discharged from the sealing tube via the transfer valve, and further wherein responsive to discharging the medium, the sealing tube contracts; and wherein the transfer valve is embedded substantially in either of a door jamb associated with the door or a window casing associated with the window.

13. The sealing system of claim 12, wherein the reservoir device includes a bladder configured to hold the medium and wherein the bladder is configured to contract and discharge a portion of the medium via the transfer valve into the sealing tube responsive to either of the door or the window closing.

14. The sealing system of claim 13, wherein responsive to the sealing tube contracting, a portion of the medium is discharged via the transfer valve into the reservoir device.

15. The sealing system of claim 12, wherein the transfer valve is configured to store a pressurized volume of the medium received from the reservoir device responsive to either of the door or the window closing and further configured to transfer a portion of the stored pressurized volume of the medium into the sealing tube after either of the door or window is in a substantially closed position.

16. The sealing system of claim 12, wherein the transfer valve is configured to store a pressurized volume of the medium received from the sealing tube responsive to either of the door or the window opening and further configured to transfer a portion of the stored pressurized volume of the medium into the reservoir device after either of the door or the window is in a substantially open position.

17. A sealing system comprising:

a reservoir device;

a sealing tube configured to expand and to contract; and a transfer valve configured to couple the reservoir device to a first end of the sealing tube;

wherein responsive to either of a door or window closing, a medium is transferred from the reservoir device via the transfer valve to the sealing tube, and further wherein responsive to receiving the medium, the sealing tube expands to substantially seal a gap between an edge of either the door or the window and a surface in proximity to the edge;

wherein responsive to either of the door or window opening, the medium is discharged from the sealing tube via the transfer valve, and further wherein responsive to discharging the medium, the sealing tube contracts; and wherein the sealing tube is embedded substantially in a longitudinal channel defined in a longitudinal surface of either of the door or the window.

18. The sealing system of claim 17, wherein the reservoir device includes a bladder configured to hold the medium and wherein the bladder is configured to contract and discharge a portion of the medium via the transfer valve into the sealing tube responsive to either of the door or the window closing.

19. The sealing system of claim 18, wherein responsive to the sealing tube contracting, a portion of the medium is discharged via the transfer valve into the reservoir device.

20. The sealing system of claim 17, wherein the transfer valve is configured to store a pressurized volume of the medium received from the reservoir device responsive to either of the door or the window closing and further configured to transfer a portion of the stored pressurized volume of the medium into the sealing tube after either of the door or window is in a substantially closed position.

21. The sealing system of claim 17, wherein the transfer valve is configured to store a pressurized volume of the medium received from the sealing tube responsive to either of the door or the window opening and further configured to transfer a portion of the stored pressurized volume of the medium into the reservoir device after either of the door or the window is in a substantially open position.

* * * * *